US008272085B2

(12) United States Patent
Finch et al.

(10) Patent No.: US 8,272,085 B2
(45) Date of Patent: Sep. 25, 2012

(54) BOAT HAMMOCK INSTALLATION SYSTEM

(75) Inventors: Justin Finch, Naples, FL (US); Gary Loomis, Ft. Myers, FL (US)

(73) Assignee: Justin Finch, Naples, FL (US)

( * ) Notice: Subject to any disclaimer, the term of this patent is extended or adjusted under 35 U.S.C. 154(b) by 164 days.

(21) Appl. No.: 12/578,584

(22) Filed: Oct. 13, 2009

(65) Prior Publication Data

US 2011/0083268 A1 Apr. 14, 2011

(51) Int. Cl.
*A45F 3/24* (2006.01)

(52) U.S. Cl. ..... 5/127; 5/128; 5/130

(58) Field of Classification Search ..... 5/127, 128, 5/129, 130
See application file for complete search history.

(56) References Cited

U.S. PATENT DOCUMENTS

| | | | | | |
|---|---|---|---|---|---|
| 260,230 | A | * | 6/1882 | Parker | 5/127 |
| 1,159,192 | A | * | 11/1915 | Dudley | 5/127 |
| 2,382,528 | A | * | 8/1945 | Anderegg | 5/128 |
| 2,524,499 | A | * | 10/1950 | Weir | 5/127 |
| 4,662,132 | A | * | 5/1987 | Tennant | 52/148 |
| 5,293,657 | A | * | 3/1994 | DeAth | 5/127 |
| 5,579,548 | A | | 12/1996 | Death | |
| 5,715,552 | A | | 2/1998 | DeAth | |
| 6,418,577 | B1 | | 7/2002 | Murphy | |
| D490,765 | S | | 6/2004 | Dominy | |
| 6,895,612 | B1 | | 5/2005 | Hamilton | |
| 6,931,678 | B2 | | 8/2005 | Boyd | |
| 7,234,404 | B2 | | 6/2007 | Tissier | |

* cited by examiner

*Primary Examiner* — Peter Cuomo
*Assistant Examiner* — Brittany Wilson
(74) *Attorney, Agent, or Firm* — Hahn Loeser & Parks LLP; Bret A. Hrivnak, Esq.

(57) ABSTRACT

The present invention includes apparatus and methods for installing a hammock upon a boat. A method of installing a hammock comprises the steps of: installing first and second hammock end mounting means upon the boat, the first and second mounting means each comprising one of a vertical mounting member and a suspending anchor to suspend ends of a hammock, where each vertical mounting member is affixed to a surface of the boat, the vertical member including a longitudinally extending member having a first end and a second end, the first end affixed to a surface of the boat, the second end being elevated above the first end, and where each suspending anchor is affixed to an elevated structure of the boat, the anchor having one or more mounting surfaces engaging the elevated structure and one or more ratchets each receiving a strap extending about the elevated structure.

25 Claims, 8 Drawing Sheets

BOAT HAMMOCK INSTALLATION SYSTEM

BACKGROUND OF THE INVENTION

1. Field of the Invention

This invention relates generally to hammocks and methods of installing hammocks on boats.

2. Description of the Related Art

Hammocks are a useful means of relaxation. And often times, boats may lack sufficient seating or areas for relaxation. Accordingly, installing a hammock on a boat may be a welcome addition. However, installing hammocks on boats is problematic. Smaller boats do not afford much space for installing hammocks. Further, structure is often lacking on boats for installing hammocks. Still further, different boats of various designs may provide varying structure and size. Finally, problems may arise by virtue of the conditions in which boats operate.

Accordingly, it is desirous to provide a system and method for installing a hammock on a boat that is capable of adapting to various boat designs and withstanding the conditions in which boats operate. Further, it is desirous to provide a system that is capable of installing a hammock on a boat that lacks sufficient structure for mounting a hammock thereon. It is also desirous to provide a system for installing a hammock on a boat that is easily removable, so to not interfere with boat operation when the hammock is not in use.

SUMMARY OF THE INVENTION

The present invention includes apparatus and methods for installing a hammock on a boat. Particular embodiments include a system for installing a hammock on a boat, the system comprising a first mechanism for mounting a first end of the hammock in an elevated position on a boat. The system may further include a second mechanism for mounting a first end of the hammock in an elevated position on a boat. For particular embodiments of the system, at least one of the first and second mounting mechanisms including a vertically extending hammock mounting member adapted to engaging a fixture affixed to an underlying surface of the boat, the vertically extending member having a first end adapted for attachment to the boat and a second end adapted for being elevated above the first end when the vertically extending member is installed on the boat with the hammock, wherein the vertically extending mounting member includes a hammock attachment member positioned along a portion of the vertical member extending above the boat. The system may further include in particular embodiments one or more stabilization members configured to extend from the vertically extending hammock mounting member for attachment to the boat such that the fixture is positioned between the one or more stabilizing members and a center of the hammock. The system may still further include, in particular embodiments, a ratchet adapted to engage one of the first or second mounting mechanisms for tensing the hammock when installed.

Particular embodiments of the present invention also includes a system for installing a hammock on a boat, the system comprising: a first mechanism for mounting a first end of the hammock in an elevated position on a boat; a second mechanism for mounting a second end of the hammock in an elevated position on a boat; at least one of the first and second mounting means including a suspended hammock mounting anchor for attachment to an elevated structure of the boat, the anchor having one or more mounting surfaces adapted for engaging the elevated structure and one or more elevated structure attachment members for attaching the anchor to the elevated structure of the boat; a hammock attachment member for securing an end of the hammock to the anchor; and, a ratchet adapted to engage one of the first or second mounting mechanisms for tensing the hammock when installed.

Particular embodiments of the present invention comprise a method of installing a hammock upon a boat. Particular embodiments of such method include the step of installing a first hammock mounting member on the boat. Further steps of such method may further include in particular embodiments installing a second hammock mounting member on the boat. In particular embodiments, the step of installing a second hammock mounting member comprising the steps of: installing a fixture on a surface of the boat for receiving a first end of a second hammock mounting member; operably engaging a first end of the second hammock mounting member with the fixture, the second hammock mounting member comprising a vertically extending mounting member; and, attaching to the boat one or more stabilizing members extending from the vertically extending member, whereby the fixture is positioned between the first hammock mounting member and the attachment of the one or more stabilizing members to the boat. Further steps of the method may include attaching a first end of the hammock to the first hammock mounting member, attaching a second end of the hammock to the second hammock mounting member using a hammock attachment member, the hammock attachment member being positioned along the vertically extending hammock mounting member at a desired location; and, tensioning the hammock between the first and second hammock mounting members until the one or more stabilizing members are tensed and the vertically extending hammock mounting member is positioned in a desired arrangement, the desired arrangement elevating a second end of the vertically extending mounting member above an underlying surface of the hammock.

The foregoing and other objects, features and advantages of the invention will be apparent from the following more detailed descriptions of particular embodiments of the invention, as illustrated in the accompanying drawing wherein like reference numbers represent like parts of the invention.

DETAILED DESCRIPTION OF DRAWINGS

Figure 1:
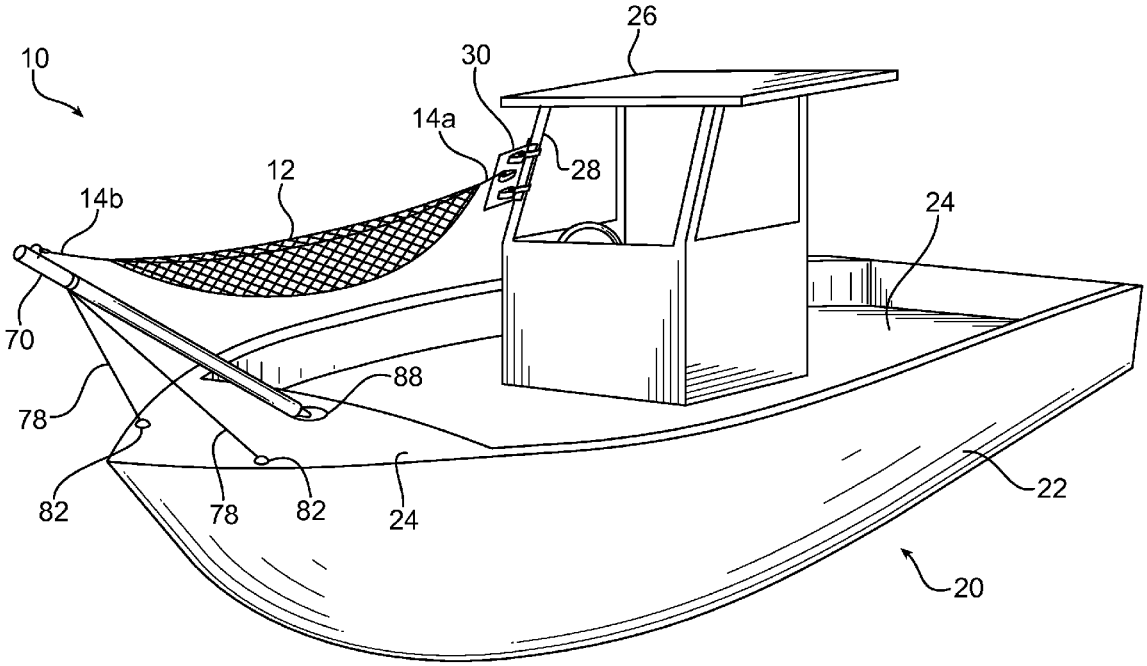
FIG. 1 is a perspective view of a boat upon which a hammock is installed using a boat hammock installation system, according to an embodiment of the invention.

Particular embodiments of the present invention provide apparatus and methods for installing a hammock on a boat. Boats may lack sufficient seating and/or space for relaxation. Hammocks can provide a comfortable and leisurely means of resting and relaxing. On a boat, however, hammocks may be difficult to use and install, especially along the deck of the boat. For example, the mounting of a hammock must be able withstand the conditions in which the boat operates. Such conditions may be unpredictable, and may provide severe forces that can make a boat unstable. Accordingly, there is a need to provide a hammock installation that is stable, secure, and able to withstand the potentially abrupt, severe, and ever-changing conditions associated with boating.

A hammock may also be difficult to install on a boat because boats often lack sufficient space in which to mount a hammock. Hammocks commonly extend 15-16 feet; however, many recreational boats extend between 15 and 32 feet. And because intermediate structure typically extends upwards from the deck along such boats (such as the helm or center console, for example), it is difficult to find sufficient space to mount a hammock. Further, boats (such as recreational boats, for example) may lack sufficient structure to sufficiently mount at least one end of a hammock in an elevated position. Still further, the structure contained on any boat may vary—even within a certain size range of boats.

It is well known that boats come in a variety of different styles, sizes, and arrangements. For example, recreational boats may comprise ski boats, fishing boats, runabouts, bowriders, cruisers, and pontoon boats. Further, the structure along any boat may vary. Boats generally include a deck resting atop a hull, which forms the lower portion of the boat which extends into the water. Along the deck, a helm is generally provided where a user operates and steers the boat. The helm may be partially surrounded by a windshield, and/or may coexist with a center console and or a bridge. A center console may provide a roof-like structure referred to as a T-top. A bridge may extend or elevate above the deck to provide an upper helm area. The deck may also include a cockpit area, which provides an area for passengers to sit, walk, or work. The cockpit often extends stern-side (rearward), but may extend around the helm and/or bow-side (frontward) of the helm, such as in bowrider and center console boats, for example. Accordingly, there is a need to provide a hammock installation system that is able to provide sufficient hammock mounting structure that the boat otherwise lacks, and to adapt to the different types, styles, and sizes of boats.

Particular embodiments of the invention include methods of installing a hammock on a boat. Exemplary embodiments of a hammock installation system 10 for use in the methods described herein are discussed in further as follows below. It is understood that this installation system may be used to install a hammock in other applications that do not involve a boat.

With reference to FIG. 1, an exemplary hammock and installation system 10 is shown. System 10 generally includes first and second mechanisms or means for mounting a hammock 12 on a boat 20. The first and second hammock mounting mechanisms may each comprise one of a suspended hammock mounting member or anchor 30 or a vertically extending hammock mounting member 70. Suspended anchors 30 secure to an elevated structure of the boat, where such structure is elevated above a hammock underlying or base surface 24—above which the hammock will hang. The underlying surface may comprise the deck 24 of the boat, for example, or any other desired surface above which the hammock is intended to hang. Vertically extending mounting members 70 provide elevated structure from which hammock will hang or mount. Vertically extending mounting members 70 are useful when the boat 20 does not otherwise provide sufficiently elevated structure from which to attach an end 14*a*, 14*b* of hammock 12. Vertically extending members 70 generally extend from the base surface 24, or another surface above which hammock 12 will hang. With reference to FIG. 1, the particular embodiment of system 10 is shown to include a first and second mounting means, where the first mounting means comprises one of a suspended hammock mounting member 30 and a vertically extending hammock mounting member 70, and the second mounting means comprises the other of the suspended mounting member 30 and the vertically extending mounting member 70. In other embodiments, first and second mounting means may both comprise either a pair of suspended mounting members 30 or a pair of vertically extending mounting members 70.

With continued reference to system 10 shown in FIG. 1, the hammock 12 is installed on a boat 20 having a center console 26. The boat 20 includes a hull 22 and a deck 24 resting atop the hull. In this example, the center console 26 rises above the deck 24 to a height sufficient for suspending an end 14*a* of the hammock 12 above the deck 24 (which is a base or underlying surface of the hammock) while a person rests therein. To suspend the other end 14*b* of the hammock 12, vertically extending hammock mounting member 70 is provided to add structure extending sufficiently above a base or underlying surface of the boat 20. In this example, base surface is deck 24. When considering the mounting height of a hammock 12, of course, consideration should be given to the weight of the ultimate user or users the hammock, as the hammock will sag under the weight of the user(s). It follows that the mounting height of a hammock 12 may vary depending upon the length of the hammock (the longer the length, the lower it will extend along its mid-length), the weight of its cargo (the size and quantity of its inhabitants), the degree of tension acting along the hammock's length, and the material and construction forming the hammock, which may cause the hammock to stretch more or less under loading.

Figure 2:
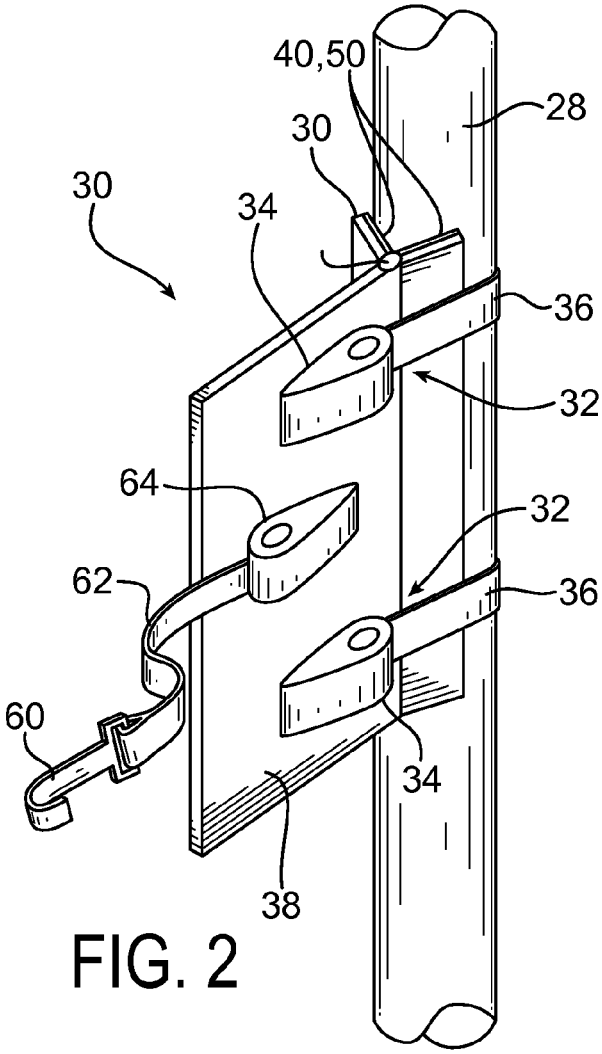
FIG. 2 is a perspective view of a suspended hammock mounting member for suspending an end of the hammock, according to an embodiment of the invention.
Figure 3:
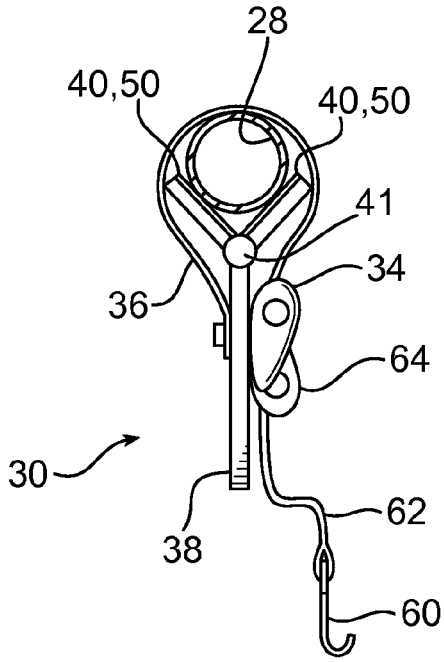
FIG. 3 is a top view of the suspended hammock mounting member of FIG. 2.

With reference to the embodiments shown in FIGS. 1-3, suspended anchor 30 includes a pair of structure attachment members 32 operably secured to a base 38, where each structure attachment member 32 comprises a ratchet 34 and strap 36 combination. Each strap 36 extends about a portion of boat elevated structure 28 to engage a ratchet 34, which tightens the strap 36 about structure 28 to secure anchor 30. By using a ratchet 34 and strap 36 combination, an adaptable or variable-sized attachment member 32 is provided, whereby suspended anchor 30 is better able to attach to a wide variety of structure having different sizes and shapes, all while still providing sufficient force and strength to maintain anchor 30 in a desired position along such structure during various and unpredictable boating conditions. For example, anchor 30 must withstand alternating forces associated with waves, in addition to maintaining sufficient grip of the structure under wet conditions. In other variations, each structure attachment member 32 may comprise any other means known to one of ordinary skill that is able to clamp or secure anchor 30 to boat structure 28 without altering, modifying, or damaging boat structure 28, whether such means is adaptable or variably-sized so to adapt to different sized and/or shaped structures 28, or is designed for specific sized and/or shaped structures 28, although this will reduce or even eliminate the adaptability of anchor 30. For example, in exemplary variations, attachment member 32 may comprise a fixed or variably-sized clamp (such as a pipe clamp, or a clamp similar to those used to on booms of windsurf boards), a U-bolt, or a bracket (or shaped plate) arranged such that structure 28 is placed between the bracket and the base 38 of anchor 30 and affixed to base 38 by way of fasteners. Of course, in particular variations structure attachment member 32 may comprise any fastener, such as a bolt, for example, that extends through an aperture (not shown) of boat structure 28. Further, in particular embodiments, suspended anchor 30 may comprise a ratchet 34 and strap 36 extending from an end of hammock 12 and about elevated structure 28.

Elevated boat structure 28 may comprise any structure elevated above a base surface of hammock 12. For example, in FIG. 1, a center console 26 provides an elevated structure 28 comprising a vertically extending frame member. While elevated structure 28 of center console 26 comprises a vertically extending frame member in the example shown, suspended anchor 30 may attach to any structure 28 extending vertically, horizontally, or in any direction there between (as it may extend in any direction relative to a base surface). It is also understood that anchor 30 may be adapted or shaped to attach to any structure 28, which may comprise, for example, a plate, beam, bar, rod, or tube.

In an effort to maintain the mounting position of anchor 30 along structure 28, portions of structure attachment members 32 and/or a structure-engaging (or mounting) surface 40 may be coated or lined with a slide-resistant or high-friction material 50. Any material known to one of ordinary skill may be used to resist sliding, such as rubber (natural or synthetic) or any other suitable polymeric or elastomeric material. Utilizing a ratchet or other tensioning member, and/or providing a slide-resistant or high-friction material 50 is helpful for maintaining the mounting position of anchor 30 along structure 28, especially when structure 28 has low-surface friction, such as when such surface is generally smooth and/or is formed of a low-friction material, such as polished, anodized, powder coated, or brushed aluminum or stainless steel, for example. Further, such material 50 may provide sufficient friction to resist sliding when the interface between anchor 30 and structure 28 becomes wet, which is a common occurrence during boat operation.

With continued reference to FIGS. 2-5, anchor 30 generally engages mounting structure 28 with one or more structure-engaging surfaces 40 (which may be coated or lined with slide-resistant material 50, as mentioned above). In the example shown, a pair of substantially flat structure-engaging surfaces 40 extend outwardly from base 38 and hinge 41 to form a V-shape, and are separated by an angle $\alpha$. In other variations, in lieu of being flat, structure-engaging surfaces 40 may include any other desired or contoured surface. For example, mounting surfaces may be arcuate or rounded, or comprise any shape better adapting to the shape of a corresponding structural member 28. Accordingly, it is recognized that structural members 28 may comprise any cross-sectional shape, such as circular (as shown), square, or rectangular, for example.

A mounting surface 40 may be fixed, that is, not movable or rotatable relative to anchor 30 or to another mounting surface 40. However, in other arrangements, one or more mounting surfaces 40 may be adjustable for the purpose of adapting to differently sized or shaped mounting structures 28. For example, with reference FIG. 2-5, one of the surfaces 40 is able to rotate relative to the other surface 40 by virtue of a hinge 41. Adjustment of a surface 40 may be made by means other than rotation. For example, one or more of the surfaces may translate in any direction or moved to a different position along anchor 30 to better adapt to mounting structure 28. Further, adjustment may be made by replacing a mounting surface 40 with a more desirable mounting surface 40, which may be differently designed or configured for engagement with a particular elevated structure 28. Still further, an anchor mounting surface 40 may modified by removing a portion of mounting surface and/or adding one or more mounting surfaces or other desired features.

Figure 4:
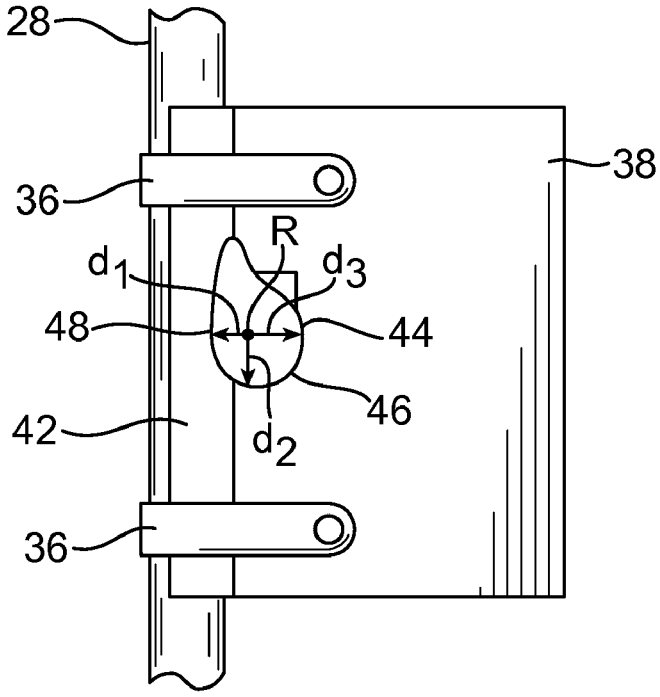
FIG. 4 is a side view of a suspended hammock mounting member shown in FIG. 2 having a cam in accordance with an embodiment of the invention.
Figure 5:
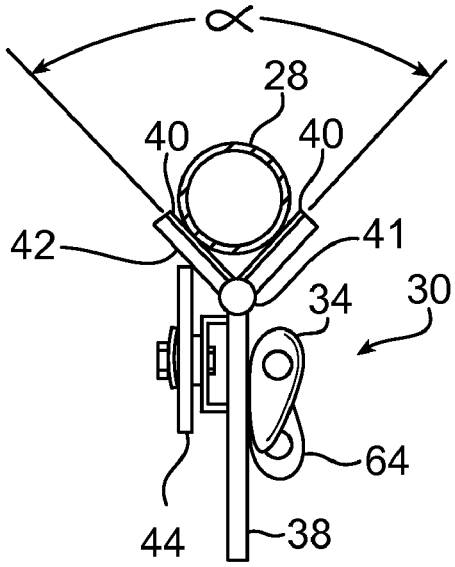
FIG. 5 is a top view of the suspending member shown in FIG. 4.

Anchor 30 may include a mechanism (or means) for controlling the rotation or positioning of mounting surface 40. With reference to FIGS. 4-5, the position controlling mechanism comprises a cam 44 having an edge 46 for engaging a structure associated with a mounting surface 40 to alter the rotational position of mounting surface 40. The distance d between edge 46 and rotational axis R varies about cam 44. For example, distance $d_1$ is less than distance $d_2$, which is less than distance $d_3$. Accordingly, as cam 44 rotates, the distance between mounting surface 40 and the rotational axis R of cam 44 changes, which rotationally repositions mounting surface 40 and angle $\alpha$ about the rotational axis of hinge 41. In other arrangements, cam edge 46 includes segments having a constant diameter (i.e., a separated from axis R by a constant distance) to provide standard positional settings for mounting surfaces 40. For example, cam edge 46 may include two segments, where each segment arranges mounting surfaces 40 to be separated by an angle $\alpha$ of 90 degrees and 120 degrees, respectively. The 90 degree setting may be useful for installing anchor 30 onto 1-2 inch pipe, while the 120 degree setting may be useful for installing anchor 30 onto 2-4 inch pipe.

In the arrangement shown, cam 44 is mounted to base 34, with a structural spacer positioned there between so to align cam 44 and its edge 46 for engagement with desired structure (such as structure 42, for example) for controlling the position of an adjustable surface 40. As shown in FIG. 5, a nut and bolt secure cam 44 to the spacer, with a general washer placed between cam 44 and the spacer, and a spring washer, such as a Bellvue washer, placed opposite the washer atop cam 44. The spring washer aids in maintaining cam 44 in a desired position. In other arrangements, any other known mechanism may be used to maintain cam 44 in a desired position, such as, for example, a spring washer, a pin, a fastener, or a mating notch and groove extending between the cam and an adjacent surface. The general washer may be made from any known material, including a low-friction material, such as PTFE, for example.

In lieu of cam 44, in other arrangements, the positional controlling mechanism comprises any other mechanism or means known to one of ordinary skill for controlling the movement or rotation of a surface 40 and/or for maintaining the surface 40 in a desired but alterable position or arrangement. For example, a pin may be used to control or maintain an adjustable structure 42 or mounting surface 40 in one or more desired positions.

With specific reference to FIGS. 2-3, anchor 30 includes a hammock attachment member 60 for receiving an end 14*a* of hammock 12. This attachment member 60 may comprise an aperture, hook, hoop, U-bolt, carabiner, or any other structure capable of securing an end 14*a* of hammock 12. Member 60 may be formed as a portion of base 38 or may attach to base 38 by any known means, such as a strap, wire, cable, aperture, hook, or hoop, for example. Attachment member 60 may be fixed relative to anchor 30 or base 38, or may be adjustably positionable or even replaceable with a differently designed or configured attachment member 60. In the configuration shown, attachment member 60 comprises a hook-like member affixed to a strap 62 for communication with a tensioning means or mechanism 64.

In the embodiment shown, tensioning mechanism 64 comprises a ratchet that accept strap 62 and is used to tense or tighten the strap 62 and ultimately the mounted hammock 12 for properly receiving a person(s) or cargo. Sufficient tension is provided so to maintain the vertically extending hammock member 70 in an elevated arrangement and the stabilizing members 78 in a tensed condition when hammock 12 is in use (i.e., receives a load, such as a person or cargo). In the arrangement shown, ratchet 64 is affixed to base 38. As ratchet 64 draws in strap 62 to shorten the distance between the ratchet 64 and attachment member 60 (and hammock 12), the hammock 12 generally becomes tenser. The tension provided may also suspend in an elevated arrangement any vertically extending hammock mounting member 70, if present. Generally, ratchet 64 is positioned between anchor 30 and hammock 12, whether or not ratchet 64 is attached to anchor 30, although in other arrangements, a ratchet 64 may be positioned on the other end 14*b* of hammock 12.

As previously discussed, a suspended anchor 30 is used to suspend an end of hammock 12 from an elevated structure 28 of boat 20. However, if boat 20 does not provide sufficient structure for mounting or suspending an end of hammock 12 in an elevated position, installation system 10 includes a vertical mounting member 70 for suspending an end of hammock 12 in an elevated position.

Figure 6:
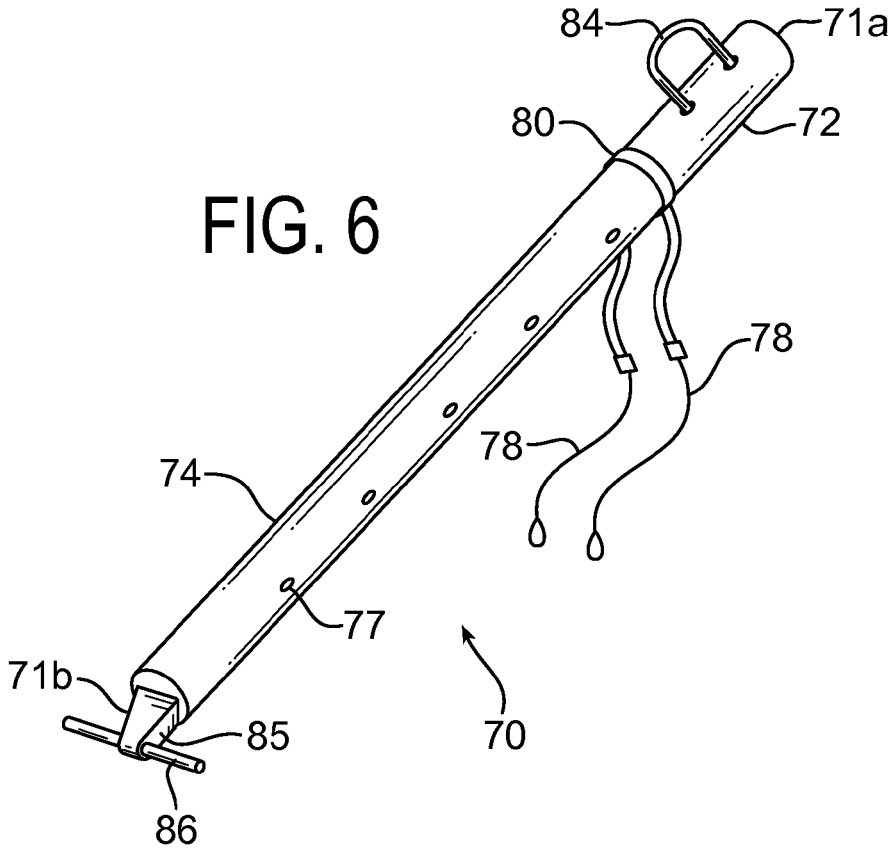
FIG. 6 is a perspective view of a vertically extending hammock mounting member for suspending an end of a hammock in accordance with an embodiment of the invention.
Figure 7:
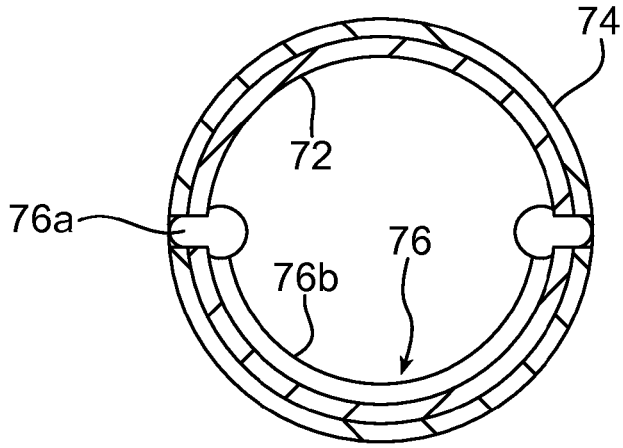
FIG. 7 is a cross-sectional view of the vertical member of FIG. 6 showing a position maintaining mechanism for constraining a first tube of the vertical member in a position relative to the second tube of the vertical member according to an embodiment of the invention.

With general reference to FIGS. 1 and 6, vertically extending hammock mounting member 70 extends longitudinally upwards from a base or underlying surface of hammock, such as deck 24, for example, or any other desired surface of boat 20, to provide elevated structure to which an end 14*b* of hammock 12 will mount. In the embodiment shown, vertical member 70 comprises a telescoping structure comprising a first tube 72 extending within a second tube 74, and includes a means or mechanism 76 for maintaining the first tube 72 in a position relative to the second tube 74. With reference to the embodiment of FIG. 7, such position maintaining mechanism 76 may comprise one or more tabs 79*a* biased outwardly by a spring 79*b*, such that a portion of each tab 79*a* extends through aligned apertures 77 of each tube 72, 74 to lock the relative position of tubes 72, 74. In other arrangements, such mechanism 76 may comprise a pin, a fastener, a cammed or threaded collar, or any other means known to one of ordinary skill in the art for constraining the position of first tube 72 relative to second tube 74. In other arrangements, system 10 may include more than one vertically extending member 70, each of which may be operably attached to form a multi-legged mechanism for supporting an end of hammock 12. In such other arrangements, at least one stabilizing member 78 may be used to stabilize the multi-legged member mechanism.

Figure 15:
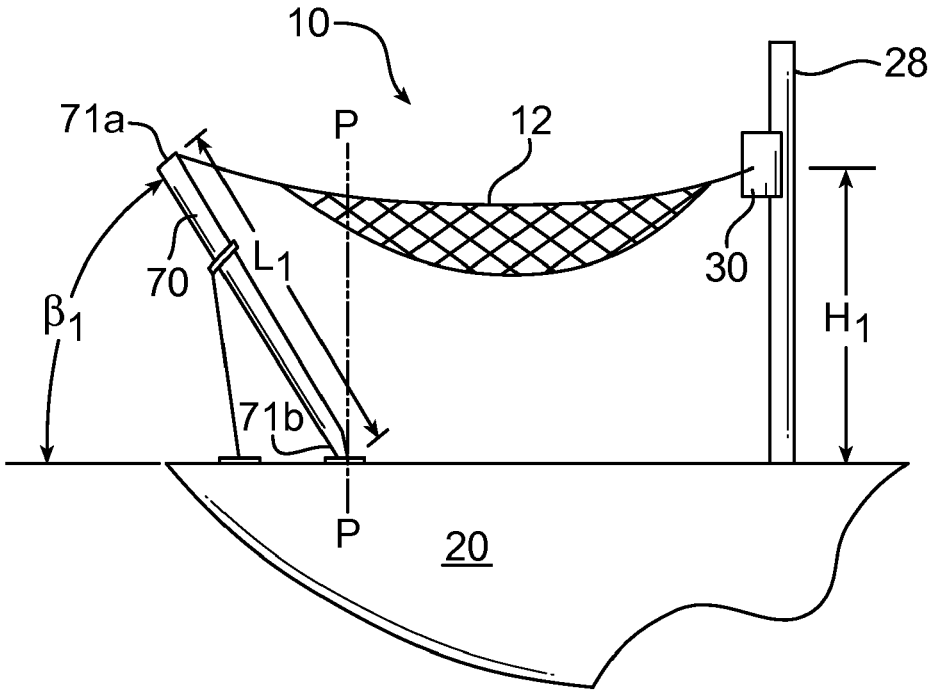
FIG. 15 is a partial side view of a boat having a hammock installed thereon according to an embodiment of the invention.
Figure 16:
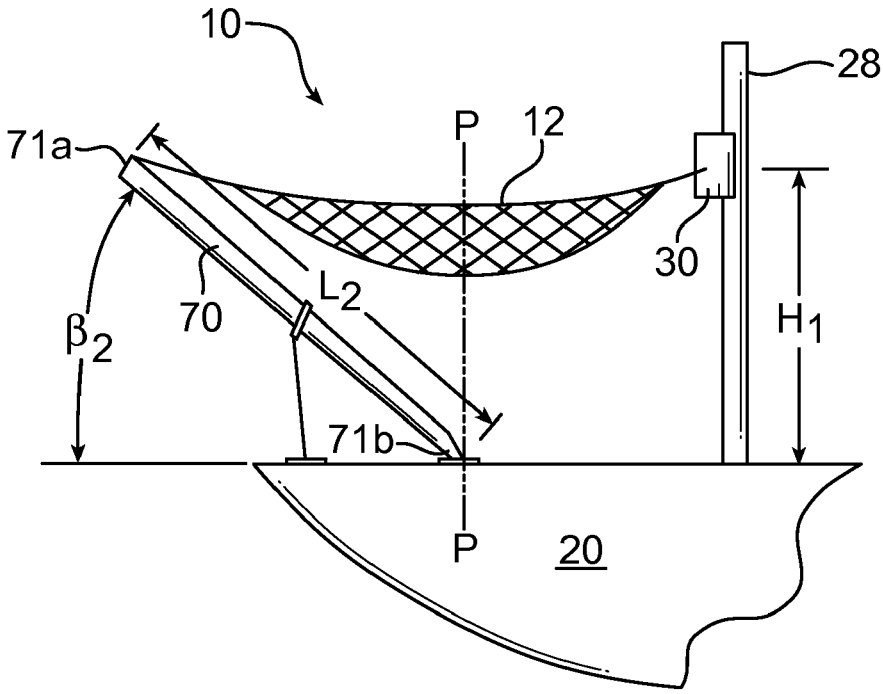
FIG. 16 is a partial side view of a boat having a bow shorter than the bow of FIG. 15, and upon which a hammock is installed according to an embodiment of the invention.

By providing a telescoping vertical member 70, installation system 10 is capable of adapting to different boats and different hammock installation configurations. It is contemplated that hammock 12 may be installed in any arrangement on a boat 20. For example, a hammock 12 may extend in a direction extending between the front (bow) and rear (stern) of boat 20 (as generally shown in FIG. 1), or sideways (i.e., between port and starboard sides) along boat 20. By further example, the length of vertical member 70 may be adjusted or altered when the elevation of hammock 12 changes. It is further contemplated that hammock 12 may be installed on differently sized boats 20 or in different sized spaces and/or when altering the orientation of hammock 12 relative to boat 20. For example, with reference to FIGS. 15 and 16, a shorter vertical member 70 may be used for longer installation areas, while longer vertical members 70 may be used for shorter installation areas. In FIG. 15, a vertical member 70 having a length $L_1$ is shown oriented at an angle $\beta_1$ above hammock underlying surface or deck 24. In FIG. 16, when installing a hammock 12 in a shorter area, a vertical member 70 having a longer length $L_2$ maintains a hammock 12 at the same height $H_1$ as in FIG. 15. As a result, vertical member 70 extends at a lower angle $\beta_2$. In summary, to maintain a hammock 12 of similar length at the same vertical position above deck 24, the installation system 10 of FIG. 16 requires a longer vertical member 70 extending at a lower inclination angle $\beta$ relative to the member 70 of FIG. 15.

In other variations, the length of vertical member 70 is extendable or alterable by other means known to one of ordinary skill in the art. For example, length may be added or subtracted or different sized members may be substituted, such as when the length of vertical member 70 is fixed and not extendable. Fixed length vertical members 70 may be desired when providing installation systems 10 for particularly sized installation areas, and/or when the system 10 will be lifting relatively heavy loads.

Figure 10:
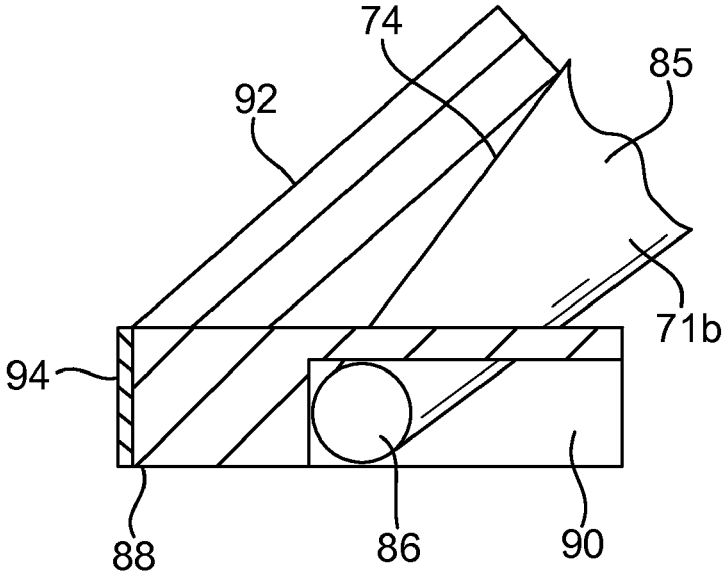
FIG. 10 is a cross-sectional view of the fixture of FIG. 9 taken along a vertical plane including line A-A, which also shows an extension of the vertical mounting member installed within the bracket.
Figure 11:
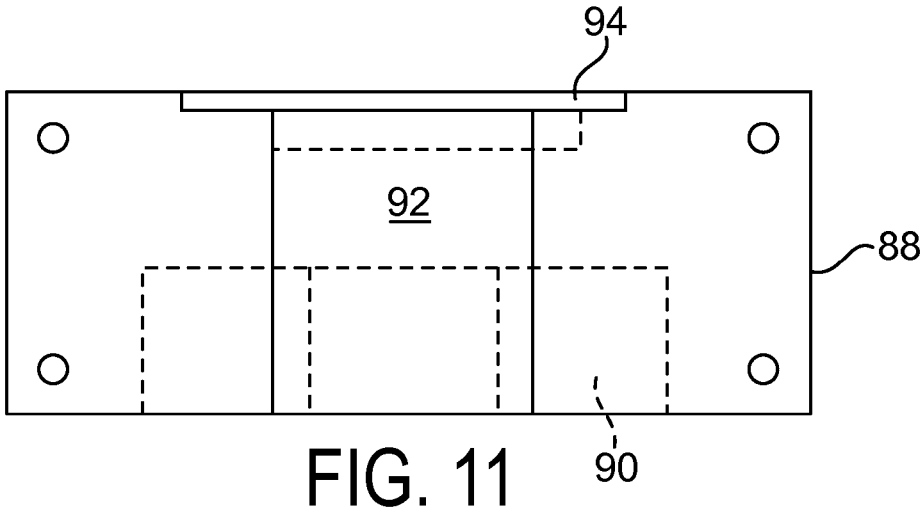
FIG. 11 is a top view of the fixture of FIG. 9.
Figure 12:
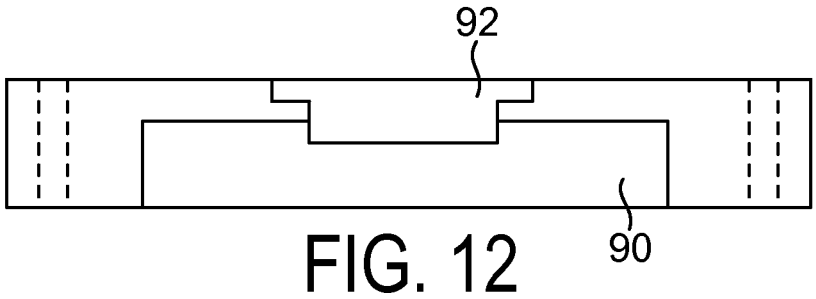
FIG. 12 is a front view of the fixture of FIG. 9.
Figure 13:
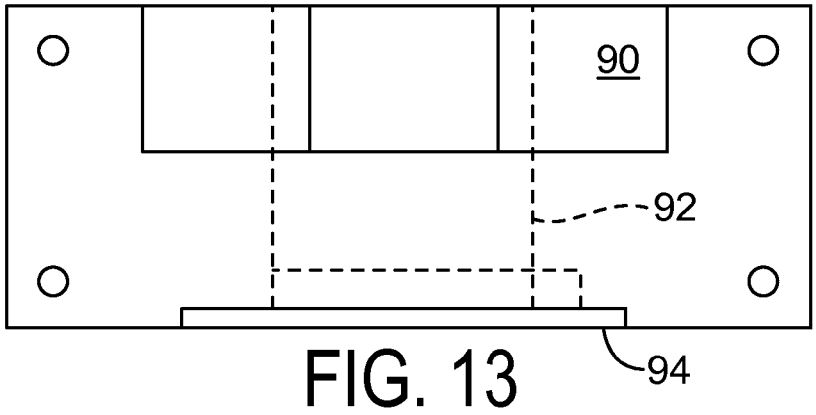
FIG. 13 is a bottom view of the fixture of FIG. 9.
Figure 14:
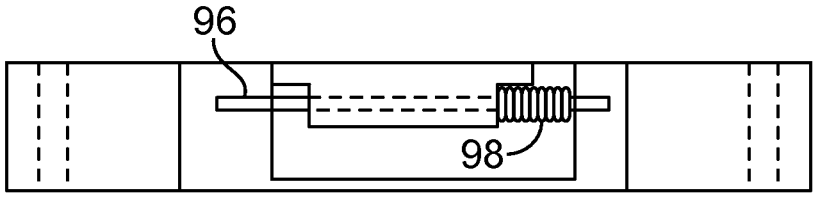
FIG. 14 is a rear view of the fixture of FIG. 9.

In the embodiment shown in FIGS. 6 and 10, vertical member 70 includes a hammock end attachment member 84, which may comprise any structure or combination of structures, including those described in association with attachment member 60. Consistent therewith, member 84 may be formed as a portion of any tube 72, 74, or may attach thereto by any known means, such as an aperture, strap, wire, cable, hock, or hoop, for example. In the arrangement shown, attachment member 84 is a U-bolt. A carabiner is then used to attach an end 14*b* of hammock 12 to attachment member 84.

In each of the arrangements shown in FIGS. 1, 15, and 16, the hammock attachment member 84 is positioned along vertical member 70 such that a plane P-P extending vertically from fixture 88 (when the boat is level) is positioned between attachment member 84 and the opposing end of hammock 14*a* (or, the other hammock attachment member 60). In this arrangement, angles $\beta_1$ and $\beta_2$ (and more generally angle $\beta$) are between 0-90 degrees. In other arrangements, angle $\beta$ can be greater than 90 degrees, but it cannot reach an angle that allows any stabilizing member 78 to become co-axial with vertically extending member 70, since this will not allow the stabilizing member 78 to maintain the vertical member 70 in an elevated arrangement, (and instead will pull the vertical member 70 downward). By maintaining angle $\beta$ less than 90 degrees, the vertically extending member 70 is directed away from hammock 12 and the opposing hammock end 14*a* to provide an attachment point for adjacent hammock end 14*b* that may extend beyond the extend of boat 20 (that is when there is insufficient space or length of boat 20 to otherwise install hammock 12, such as is shown by example in FIG. 16).

When suspending hammock 12 upon boat 20, vertical member 70 has an elevated free end 71*a* and a boat-engaging (or base surface-engaging) end 71*b*. The boat-engaging end 71*b* is constrained along a hammock base or underlying surface. To constrain boat-engaging end 71*b* to the boat, such end engages a fixture 88. The fixture 88 may generally constrain the boat-engaging end 71*b* in x, y, and z directions (i.e., to make the vertical member positionally fixed), yet fixture 88 may facilitate rotation or pivotability of vertical member 70 about end 71*b* when retained in fixture 88. In the embodiment shown in FIGS. 10, 15, and 16, fixture 88 may still allow rotation of vertical member 70 relative to the boat 20 or the base surface (i.e., the surface to which it mounts). Fixture 88 may comprise any device or method known to one of ordinary skill in the art for attaching the vertical member 70 or boat-engaging end 71*b* to an underlying surface of hammock 12. For example, the device or method may comprise a male-female means, whereby either the vertical member 70 or the fixture 88 includes a male member and the other includes a cavity or aperture for receiving the male member.

With reference to FIGS. 9-14, fixture 88 comprises a mounting bracket 88 having a cavity (or female receiving means) 90 shaped for receiving an extension (or male member) 86 attached to the vertical member boat-engaging end 71*b*. A spacer 85 may be placed between extension 86 and a larger cross-section of vertical member 70, which is better received by fixture 88 when inserting extension 86 therein. A second cavity 91 extends centrally from cavity 90 to an upper surface of bracket 88 for receiving vertical member 70. Further, second cavity 91 is sized to allow rotation of vertical member 70 while extension 86 is retained within cavity 90. To facilitate rotation of vertical member 70 within bracket 88, at least a portion of a cross-section of extension 86 is rounded (i.e., circular, oval, or at least partially arcuate). A cap 92 may be included to substantially cover the inside of bracket 88 by substantially covering second cavity 91. Cap 92 is capable of pivoting upwards relative to the bracket top surface as vertical member 70 enters the void along the bracket top surface, and/or as vertical member 70 rotates. Any means known to one of ordinary skill in the art for facilitating rotation of cap 92 relative to bracket 88 may be used. For example, with reference to FIG. 14, a pin 96 or the like may be positioned within bracket 88, to which cap 92 engages to facilitate rotation of cap 92. A spring 98 may be used to bias cap 92 in a closed position, such that when the vertical member 70 is not secured within bracket 88, the cap 92 remains closed during boat operation. In other arrangements, cap 92 is manually removable.

With reference to FIGS. 1 and 6, a pair of stabilization (or stabilizing) members 78 extend from vertical member 70 in an effort to provide stability to vertical member 70. Each of the stabilization members 78 are positioned on either longitudinal side of vertical member 70 in front of fixture 88 to provide lateral and vertical stability to vertical member 70 when it is elevated to suspend hammock 12. In the arrangement shown, the stabilization members 78 extend laterally from each side of vertical member 70 to form a tripod-like arrangement. The stabilization members 78 shown are cables that become tensed to provide stabilization when hammock 12 is installed under tension. In other variations, stabilization members 78 may formed of other flexible materials, or may formed of rigid material, such as a bar, rod, or tube, for example. Stabilization members 78 are affixed to the boat 20 by any means or mechanism 82 known to one of ordinary skill in the art, such as the use of D-rings (as shown in FIG. 1) or fasteners, for example.

Figure 8A:
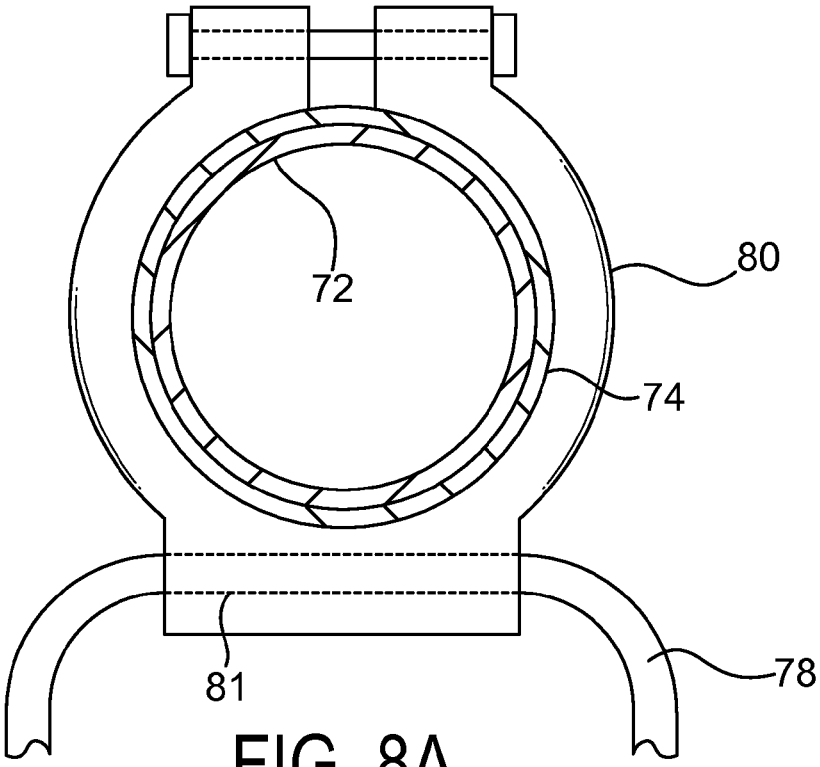
FIG. 8A is a top view of a collar for securing stabilizing members to the vertical mounting member according to an embodiment of the invention.
Figure 8B:
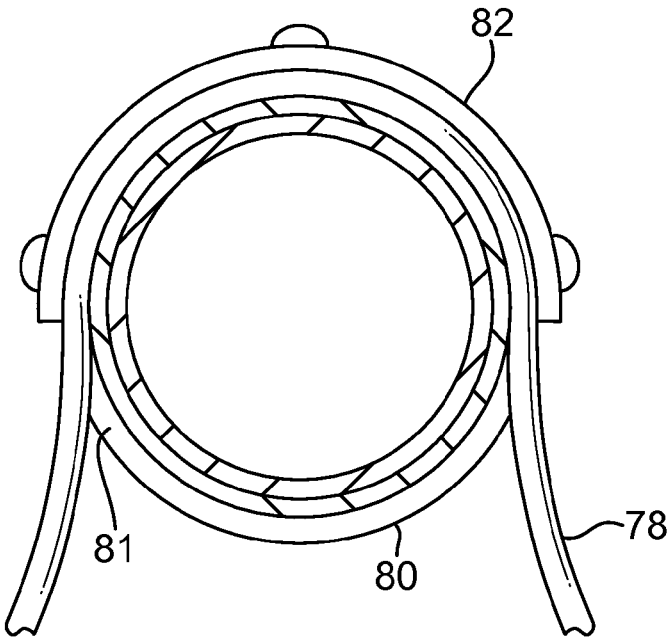
FIG. 8B is a top view of an alternative collar for securing stabilizing members to the vertical mounting member according to an embodiment of the invention.
Figure 9:
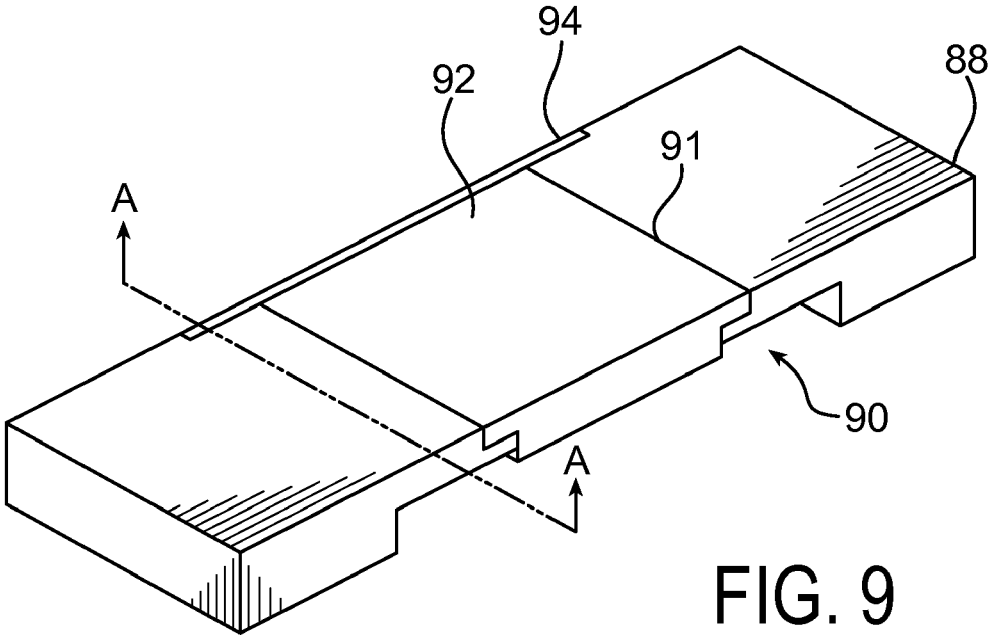
FIG. 9 is a perspective view of an underlying surface mounting fixture for a vertical mounting member according to an embodiment of the invention.

Stabilizing members 78 are also operably attached to vertical member. In the variation shown in FIGS. 6, 8A, and 8B, members 78 attach to vertical member 70 by way of a collar 80. The collars shown include a groove 81 in which members 78 pass. In the variation of FIG. 8B, the stabilization members pass around vertical member 70, unlike the variation of FIG. 8A. A cap 82 may be used to fix the position of each stabilization member 78 along vertical member 70. In other variations, in lieu of collar 80, any other means or mechanism for attaching and constraining the position of stabilization members 78 to vertical member 70 known to one of ordinary skill in the art maybe used, such as an aperture, hook, or hoop, for example.

The stabilization members 78 shown are adjustable in length. Adjustability allows the length of stabilization members 78 to change as necessary when installing a hammock 12 in different arrangements, such as shown in FIGS. 15 and 16, for example. Otherwise, stabilization members 78 of different fixed lengths may be substituted when using a vertical member 70 in different hammock installation arrangements. In the variation shown in FIG. 6, free ends of each cable is non-slidably fixed within a fixture that is also slidably attached to the other cable to prevent the free end, or non-tensed end, of each cable from freely dangling. Stabilization members 78 may be adjustable whether the members 78 are flexible or rigid.

In operation, installation system 10, as described above, secures and suspends a hammock 12 onto a boat 20 using a suspended mounting anchor 30 and/or a vertically extending mounting member 70. Accordingly, methods of installing may include a step of attaching the suspended hammock mounting anchor 30 to elevated structure 28 in a sufficiently elevated position to secure an end of hammock 12. Anchor 30 includes one or more structure engaging or mounting surfaces 40 for engaging elevated structure 28. With regard to the variation shown in the FIGURES, anchor 30 includes one or more structure attachment members 32 each comprising a strap 36 extending about structure 28 and returning to a ratchet 34. Each ratchet 34 tightens each corresponding strap 36 to secure anchor 30 to structure 28, whereby one or more structure engaging surfaces 40 engage elevated structure 28. In particular embodiments, the position of the one or more structure mounting surfaces 40 relative to anchor 30 is adjustable. In particular variations, the one or more mounting surfaces 40 comprise a pair of hinged surfaces 40. Prior to installation, a cam 44 may be used to adjust the angle $\alpha$ as necessary to better configure the position of mounting surfaces 40 for engagement with structure 28.

Such methods may also include a step of attaching the hammock 12 to anchor 30 by way of a hammock attachment member 60. With regard to the variation shown in the FIGURES, the hammock attachment member 60 comprises a hook-like member attached to a strap 62 in operable communication with a ratchet 64.

Such methods may also include a step of installing a vertical mounting member 70 to an underlying surface of boat 20 for securing an end of hammock 12. According to the variation shown in the FIGURES, a boat-engaging end 71*b* of vertical mounting member 70 engages a fixture 88 engaging the underlying surface of boat 20. Further steps may include securing one or more stabilizing members 78 extending from vertical member 70 to the boat 20 such that boat-engaging end 71*b* is positioned between stabilizing members 78 and a longitudinal center of the hammock 12, whereby the free-end

71*a* of vertical member is oriented to extend away from the hammock 12. With reference to FIGS. 15-16, directing free-end 71*a* away from hammock 12 may include positioning the vertically extending hammock mounting member 70 such that a plane P-P extending vertically from the fixture 88, when the boat is level relative to a ground plane, is positioned between the free-end 71*a* and the first (or opposing) hammock mounting member or the center of hammock 12. In particular embodiments, each of a pair of stabilizing members 78 is secured on opposing sides of a vertical plane extending through a longitudinally extending centerline of the hammock 12, or a vertical plane extending between the ends of the hammock 12. In particular arrangements, stabilizing members 78 are affixed symmetrically about an axis extending between the vertical member 70 and anchor 30 (i.e., the lengthwise centerline of hammock 12). Such methods may further include the step of selecting a length of one or more vertically extending members 70 and/or of the one or more stabilizing members 78 to provide a desired installed position. Such steps of selecting lengths enables one to orientate vertical member 70 such the installed hammock is generally level, which may provide that hammock end attachment member 84 is generally level with the attachment member 60 of anchor 30. In particular variations, the length of vertically extending members 70 and/or of the one or more stabilizing members 78 is adjustable.

Once vertical member 70 and anchor 30 are installed, hammock 12 can be installed by the steps of attaching hammock ends 14*a*, 14*b* to vertical member 70 and anchor 30, respectively, and the step of tensing hammock 12, such as, for example, by use of a ratchet 64. A ratchet 64 may attach to either anchor 30 or and vertically extending member 70.

The system 10 shown in the figures is one arrangement for installing a hammock 12 on a boat 20. Because structures on boats are known to vary, as different boats are known to exist, system 10 as described above may be altered to adapt to the different boat structures. For example, it is contemplated that in lieu of having a first end 14*a* of hammock 12 affixed to a suspended anchor 30 and a second end 14*b* of hammock 12 affixed to a vertical mounting member 70, both hammock ends 14*a*, 14*b* may each be attached to an independent suspended anchor 30 or a vertical mounting member 70. For example, utilizing two vertical members 70 may be desired when no center console 26 exists, when desiring to extend hammock 12 laterally (i.e., side-to-side) across a boat, or otherwise when sufficient structure does not exist to utilize a suspended anchor 30. Likewise, when sufficient structure exists to utilize suspended anchors 30 for independently suspending each end of hammock 12, both hammock ends 14*a*, 14*b* may be attached to an independent suspended anchor 30 without use of a vertical member 70.

While this invention has been described with reference to particular embodiments thereof, it shall be understood that such description is by way of illustration and not by way of limitation. Accordingly, the scope and content of the invention are to be defined only by the terms of the appended claims.

What is claimed is:

1. A system for installing a hammock on a boat, the system comprising:

a first mechanism for mounting a first end of the hammock in an elevated position on a boat;

a second mechanism for mounting a second end of the hammock in an elevated position on a boat;

the second mounting mechanism including a vertically extending hammock mounting member extending longitudinally between a first end adapted for operable attachment to an underlying surface of the boat and a second end adapted for being elevated above the first end when the vertically extending member is installed on the boat with the hammock, wherein the vertically extending mounting member is configured to have the second end of the hammock operably attached at a location along the vertically extending mounting member above the first end of the vertically extending mounting member as the vertically extending hammock mounting member extends from its first end to its second end in a direction away from the first end of the hammock;

one or more stabilizing members configured to extend downward from the vertically extending hammock mounting member between a location above the first end to a location arranged along the boat such that the first end of the vertically extending hammock mounting member is positioned in a longitudinal direction of the hammock between the one or more stabilizing members and the first end of the hammock and such that the location at which the one or more stabilizing members attach to the boat is arranged in a longitudinal direction of the hammock between the first end of the vertically extending hammock mounting member and the location along the vertically extending hammock mounting member to which the second end of the hammock is operably attached; and, a tensioning mechanism adapted to engage the first mounting mechanism or the first end of the hammock for tensing the hammock when installed.

2. The system of claim 1, wherein the vertically extending hammock mounting member has an adjustable length.

3. The system of claim 1, wherein at least one of the one or more stabilizing members have an adjustable length.

4. The system of claim 1, wherein each of the one or more stabilizing members each comprise a flexible cable.

5. The system of claim 1, wherein the first mounting mechanism comprises a suspended hammock mounting anchor for attachment to an elevated structure of the boat, the anchor having:

two or more elevated structure engaging surfaces adapted for engaging the elevated structure, at least one of the one or more elevated structure engaging surfaces being pivotably attached to the suspended hammock mounting anchor;

one or more structure attachment members for attaching the anchor to the elevated structure of the boat; and, a hammock attachment member for securing a hammock end to the suspending anchor.

6. The system of claim 5, wherein at least a portion of the one or more structure engaging surfaces is a slide-resistant surface.

7. The system of claim 5, wherein the one or more hammock attachment members includes one or more ratchets adapted for receiving one or more straps attached to the anchor for attaching the anchor to the elevated structure of the boat.

8. The system of claim 5, wherein the two or more structure engaging surfaces are arranged such that a cross-section of the arrangement of two or more structure engaging surfaces taken in a lengthwise direction generally forms a V-shape to receive the elevated structure of the boat.

9. The system of claim 5, wherein the first mounting member includes a mechanism for controlling the rotation and positioning of the two or more mounting surfaces relative each other.

10. The system of claim 1, wherein the vertically extending hammock mounting member is operably attached to the underlying surface of the boat and the second end of the hammock is operably attached to the vertically extending hammock mounting member such that the vertically extending hammock mounting member is arranged to extend longitudinally from its first end in a direction away from the first end of the hammock and such that the location at which the one or more stabilizing members attach to the boat is arranged in a longitudinal direction of the hammock between the first end of the vertically extending hammock mounting member and the location along the vertically extending hammock mounting member to which the second end of the hammock is operably attached, the first end of the hammock being operably attached to the first mounting mechanism which is operably attached to the boat.

11. The system of claim 10, wherein the second end of the hammock is operably attached to the vertically extending hammock mounting member by way of a hammock attachment member.

12. The system of claim 10, wherein the second end of the hammock extends beyond an extent of the boat.

13. The system of claim 1, wherein the second mechanism is a pivotable second mechanism for mounting the second end of the hammock in a desired elevated position on a boat, whereby the first end of the vertically extending hammock mounting member is adapted for pivotable retention with a fixture comprising a mounting bracket that is affixed to an underlying surface of the boat.

14. The system of claim 13, wherein the fixture is installed upon the underlying surface of the boat, the first end of the vertically extending hammock mounting member being pivotally attached to the boat by the fixture, the second end of the hammock being operably attached to the vertically extending hammock mounting member such that the vertically extending hammock mounting member is arranged to extend longitudinally from its first end in a direction away from the first end of the hammock and such that the location at which the one or more stabilizing members attach to the boat is arranged in a longitudinal direction of the hammock between the fixture and the location along the vertically extending hammock mounting member to which the second end of the hammock is operably attached, the first end of the hammock being operably attached to the first mounting mechanism which is operably attached to the boat.

15. The system of claim 13, wherein the first end of the vertically extending member and the fixture are adapted for male-female engagement.

16. The system of claim 15, wherein the fixture includes a cavity for receiving a pair of extensions extending outwardly from the first end of the vertically extending hammock mounting member, the pair of extensions extending laterally relative the longitudinal extension of the vertically extending hammock mounting member from opposing sides of the vertically extending hammock mounting member.

17. The system of claim 16, wherein the fixture includes a cap pivotably attached to the fixture for generally covering the cavity before or after the fixture is used to retain the first end of the vertically extending hammock mounting member.

18. A method of installing a hammock upon a boat, the method comprising the steps of:

installing a first hammock mounting member on the boat;

installing a second hammock mounting member on the boat, the second hammock mounting member comprising a vertically extending mounting member extending longitudinally between a first end and a second end, the step of installing comprising the steps of:

operably attaching the first end of the vertically extending mounting member to an underlying surface of the boat such that the vertically extending mounting member extends vertically from the underlying surface;

attaching to the boat one or more stabilizing members extending from the vertically extending member, whereby the first end of the vertically extending hammock mounting member is positioned in a longitudinal direction of the hammock between the first hammock mounting member and the attachment of the one or more stabilizing members to the boat, the hammock extending longitudinally between first and second ends;

attaching the first end of the hammock to the first hammock mounting member;

attaching the second end of the hammock to the second hammock mounting member along the vertically extending hammock mounting member at a desired location above the first end of the vertically extending hammock mounting member; and, tensioning the hammock between the first and second hammock mounting members until the one or more stabilizing members are tensed and the vertically extending hammock mounting member is positioned in a desired arrangement, the desired arrangement elevating the second end of the vertically extending mounting member above both the underlying surface of the boat, whereby the first end of the vertically extending hammock mounting member is arranged in a longitudinal direction of the hammock between the one or more stabilizing members and the first end of the hammock such that the vertically extending hammock mounting member extends longitudinally from the first end to the second end in a direction away from the first end of the hammock relative a longitudinal direction of the hammock and such that the location at which the one or more stabilizing members attach to the boat is arranged in a longitudinal direction of the hammock between the first end of the vertically extending hammock mounting member and the location along the vertically extending hammock mounting member to which the second end of the hammock is operably attached.

19. The method of claim 18 further comprising the steps of:

selecting and fixing a desired length of the vertically extending hammock mounting member; and, selecting and fixing a desired length for each of the one or more stabilizing members.

20. The method of claim 19, wherein the vertically extending hammock mounting member and the one or more stabilizing members each have an adjustable length.

21. The method of claim 18, wherein the step of tensioning is achieved by a ratchet.

22. The method of claim 18, wherein the step of installing a first hammock mounting member includes the steps of:

positioning the first hammock mounting member comprising a suspended hammock mounting anchor in a desired elevated position along an elevated structure of the boat such that one or more mounting surfaces of the anchor engage the elevated boat structure; and, affixing the anchor along the elevated structure using one or more structure attachment members;

where the step of attaching a first end of the hammock to the first hammock mounting member is achieved by use of a second hammock attachment member positioned along the anchor.

23. The method of claim 18, the step of installing the second hammock mounting member on the boat further comprising the step of:

installing a fixture comprising a mounting bracket on the underlying surface of the boat for receiving the first end of a vertically extending mounting member, whereby the first end of the vertically extending mounting member is pivotably mounted with the fixture such that the vertically extending mounting member extends vertically from the fixture and is pivotable relative the underlying surface in a longitudinal direction of a hammock.

24. The method of claim 23, wherein the desired arrangement in the step of tensioning includes positioning the vertically extending hammock mounting member such that a plane extending vertically from the fixture, when the boat is level relative to a ground plane, and perpendicular to the longitudinal direction of the hammock is positioned between a free end of the vertically extending mounting member and the first hammock mounting member.

25. The method of claim 18, wherein the second end of the hammock extends beyond an extent of the boat.

* * * * *